United States Patent [19]

Paulitsch

[11] 4,197,730

[45] Apr. 15, 1980

[54] COOLING ARRANGEMENT

[75] Inventor: Hans Paulitsch, Bad Reichenhall, Fed. Rep. of Germany

[73] Assignee: Stahlwerke Peine-Salzgitter Aktiengesellschaft, Peine, Fed. Rep. of Germany

[21] Appl. No.: 913,079

[22] Filed: Jun. 6, 1978

[30] Foreign Application Priority Data

Jun. 11, 1977 [DE] Fed. Rep. of Germany ..... 2726473

[51] Int. Cl.[2] ..... B21B 43/00; B21B 45/02

[52] U.S. Cl. ..... 72/201; 266/113

[58] Field of Search ..... 72/200, 201; 134/64 R, 134/82, 83, 122 R, 199; 148/153, 155, 156; 266/113

[56] References Cited

U.S. PATENT DOCUMENTS

| | | | |
|---|---|---|---|
| 1,211,277 | 1/1917 | Bloom | 266/113 X |
| 2,307,694 | 1/1943 | Malke | 134/122 R |
| 3,552,730 | 1/1971 | Kawecki | 148/153 X |
| 3,621,696 | 11/1971 | Norlindh | 72/201 |
| 3,885,581 | 5/1975 | Dahan et al. | 266/113 X |
| 3,895,139 | 7/1975 | Brown et al. | 266/113 X |

FOREIGN PATENT DOCUMENTS

| | | | |
|---|---|---|---|
| 15299 | 7/1965 | Netherlands | 134/122 R |
| 386996 | 6/1973 | U.S.S.R. | 266/113 |

*Primary Examiner*—Ervin M. Combs
*Attorney, Agent, or Firm*—Michael J. Striker

[57] ABSTRACT

A cooling arrangement, especially but not exclusively suited for cooling rolled stock such as wires and bars, has two end members provided with axially aligned passages through which a workpiece can travel. The end members are connected by an annularly arranged series of bars between which spaces are left free so that cooling fluid admitted into contact with the workpiece can rapidly flow off again. The space surrounded by the bars converges in the direction of travel of the workpiece.

9 Claims, 6 Drawing Figures

A
B
1
2
3
3₁
4
4a
5
6
7
8
9
9a
10
11
12
13
14
14a
15
16
17
19
19a

COOLING ARRANGEMENT

BACKGROUND OF THE INVENTION

The present invention relates generally to a cooling arrangement.

More particularly, the invention relates to a cooling arrangement for rolled materials, such as wires, rods and the like.

On completion of the final rolling step these materials, especially wire, must be chilled rapidly and repeatedly; such chilling must be as uniform and intensive as possible over the entire surface area of the workpiece. Moreover, to obtain the desired effect it is necessary—as explained e.g. in U.S. Pat. No. 1,211,277—to remove the cooling fluid quickly after each chilling step so that the heat at the core of the workpiece can quickly raise the temperature of the workpiece surface again.

To effect such chilling it is known to use tubes through which the workpiece, such as wire, travels to be contacted on one tube section with a cooling fluid (e.g. water) which is rapidly withdrawn at another tube section. It is also known to arrange several such tubes one behind the other, to provide an installation in which the wire can be repeatedly chilled and allowed to reheat (due to its core heat) intermediate the chilling stations.

One problem with this known state of the art is that it is not well suited for the production of special high-quality wires, for example wires in which a core with fine-striped perlite and with an outer martensite layer of a specific thickness is to be produced. The known arrangements permit a rapid application of the cooling medium to the wire surface, but do not permit a rapid enough subsequent withdrawal of the cooling medium out of contact with the surface. This, however, is a major requirement when it is desired to produce certain steels of uniform high quality, since to obtain these it is necessary to subject the workpiece to rapid chilling (to produce a maximum temperature difference between the workpiece core and the workpiece surface) and thereafter to assure equally rapid temperature equalization between the core and the workpiece surface due to reheating of the surface by the heat of the core.

In the known cooling arrangements the length of the path portion in which the workpiece is first contacted with cooling fluid is quite substantial; this means—especially if the workpiece coming from the final rolls of the mill travels at a high rate per unit time—that the length of the path portion in which the cooling fluid is subsequently conducted away from the workpiece must also be very long, since otherwise it is impossible to remove all of the cooling fluid. Because of this, the known arrangements are not suitable under the special circumstances outlined above, since the duration of contact between the cooling medium and the workpiece is too long to permit the necessary rapid chilling and equally rapid reheating (due to the core heat) of the workpiece surface.

Moreover, the known arrangements do not permit contacting of the workpiece over a substantial length with an adequate quantity of cooling fluid, since large portions of the path travelled by the workpiece are shielded by long workpiece-guiding tubes which prevent access of the cooling fluid to the workpiece. Hence, only small and inadequate quantities of cooling fluid can be sprayed onto the workpiece through a nozzle at one end of the respective guide tube—and the thus admitted cooling fluid can moreover be removed only through a few small bores at the other end of the guide tube. Since these bores necessarily create a flow resistance for the cooling fluid, they increase the dwell time of the fluid (i.e., the time for which it remains in contact with the workpiece surface). Thus, neither the initial chilling nor the subsequent reheating of the workpiece can take place fast enough to meet the requirements which are made when steel of uniform high quality is to be produced.

Finally, the known arrangements have still a further disadvantage, in that the ends of workpieces (especially wires) travelling through the guide tubes tend to become caught in the bores or slots provided in the guide tubes for evacuation of the cooling fluid. This leads inevitably to malfunctions and consequently to uneconomical machine down-time.

Another prior art arrangement is known from German Patent DE-PS No. 557,455. Here, the workpieces are guided through a housing which is provided with several annular water-stripping elements. Because of the guidance of the workpieces these elements must be arranged in close succession so that the cooling water can be sprayed only onto short increments of the workpiece surface. Sudden chilling of the workpiece surface over a substantial length of the same is not possible, nor can uniform chilling be obtained by the disclosed spraying action. This arrangement is, therefore, suited for its own specific purpose but not for treating workpieces of the type outlined above, especially since immediately downstream of ech of the stripping elements another cooling step takes place so that due to the close spacing of these elements, the requisite reheating of the workpiece from the core heat cannot occur.

SUMMARY OF THE INVENTION

Accordingly, is is an object of the invention to overcome the disadvantages of the prior art.

More particularly, it is an object of the invention to provide an improved arrangement for the intermittent cooling of workpieces produced by rolling, particularly or wires, rods and the like.

Another object is to provide such a cooling arrangement which makes it possible to bring large quantities of cooling fluid into sudden contact with the workpiece surface over a substantial length of the workpiece, and to guide such cooling fluid away again from the workpiece in the briefest possible time, in order to obtain highly intensive chilling of the workpiece surface and a sudden temperature differential between the same and the workpiece core.

A concomitant object is to provide such an arrangement whose overall required length may be short so that its operation is economical, due to the fact that the required workpiece treatment is effected and completed rapidly.

Still another object is to provide an arrangement of the type in question in which guidance of the workpieces, especially of wires, is so improved that malfunctions resulting from the workpiece being caught in the guiding arrangement, are fully or at least substantially precluded and a central guidance is obtained for the workpieces without requiring lateral support.

In keeping with these objects and with still others which will become apparent hereafter, one feature of the invention resides in a cooling arrangement, particularly for cooling rolled stock including wires, rods and the like, comprising a first end member and a second end member which are longitudinally spaced from one another and which have respective axially aligned passages, a plurality of rods connecting the end members and angularly spaced about the axis of alignment of the passages, the rods having first ends connected to the first end member on a first circle surrounding the passage of the first end member and also having second ends connected to the second end member on a smaller-diameter second circle surrounding the passage of the second end member, so that the space bounded by the bars converges from the first towards the second end member, and means for admitting cooling fluid into contact with a workpiece travelling through the passages, so that the cooling fluid can escape between the bars subsequent to such contact.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figures 1, 2, 3, 4:
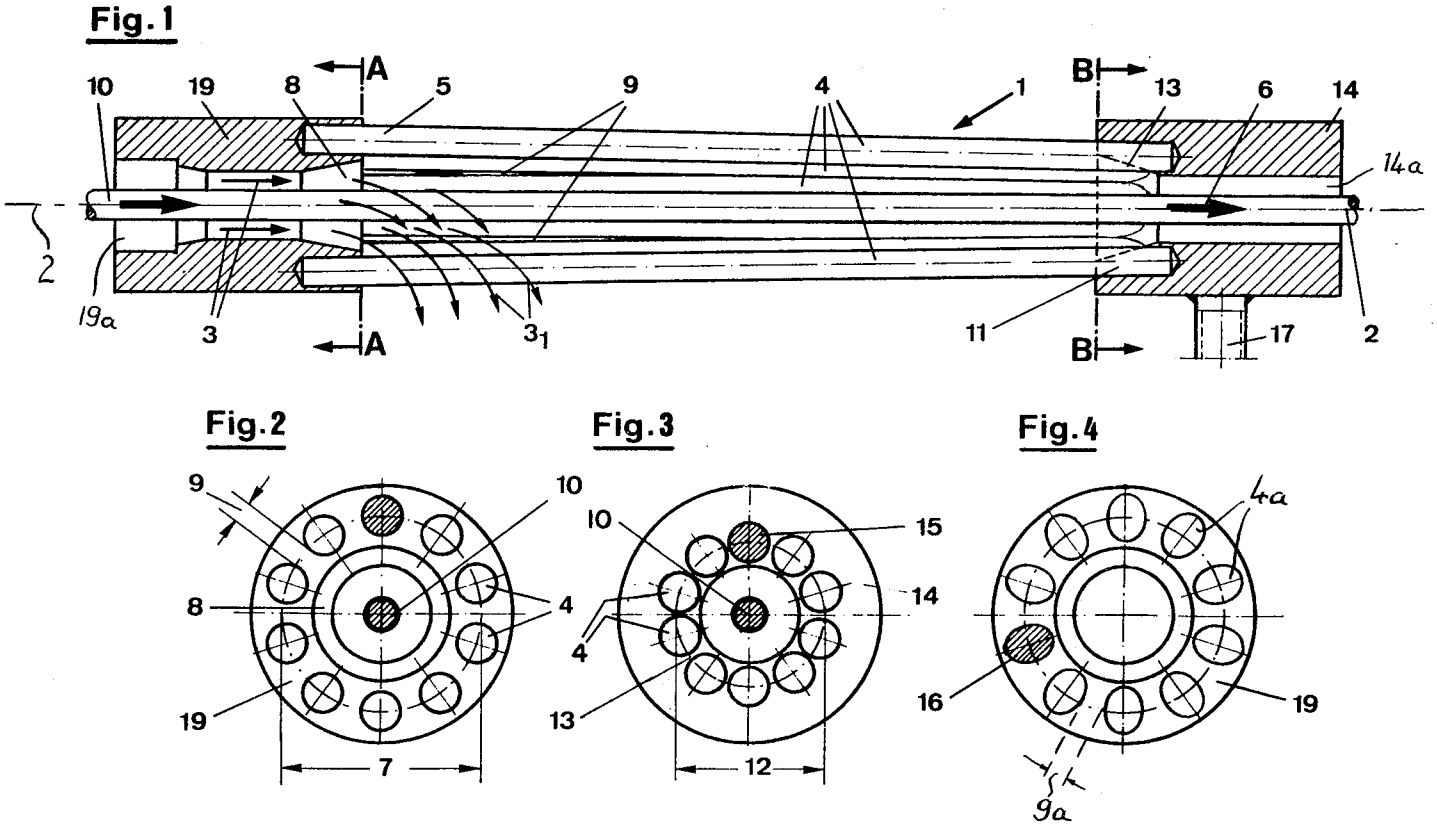
FIG. 1 is a longitudinal section through an embodiment according to the invention.
FIG. 2 is a section on line A—A of FIG. 1.
FIG. 3 is a section on line B—B of FIG. 1.
FIG. 4 is a sectional view similar to FIG. 2 but showing a different embodiment.

A first embodiment of the invention is illustrated in FIGS. 1–3. Its purpose is to cool a workpiece 10 (e.g. a wire, bar or the like) which travels from a source (e.g. a not illustrated rolling mill) in direction of the arrow 6 through the arrangement according to the present invention.

The arrangement is designated in toto with reference numeral 1 and has an inlet section 19 and an outlet section 14. The inlet section 19 has a passage 19*a* through which the workpiece 10 travels and which merges at its downstream end into a nozzle 8 of diverging cross-section. Similarly, the outlet section 14 has at its upstream end an inlet nozzle 13 which converges in downstream direction and merges with a passage 14*a*. The cental axes 2 of the sections 19 and 14 are aligned and coincide with the axis of the workpiece 10.

Sections 19 and 14 are connected by a plurality of longitudinally extending rods or bars 4 which in this embodiment are of circular cross-section (see FIGS. 2 and 3). The upstream ends 5 of the rods 4 are secured in the section 19 (e.g., by welding, threading or the like) and located on a circle 7 (FIG. 2) which surronds the nozzle 8 and is concentric to the axis 2. The downstream ends 11 of the rods 4 are similarly secured to the section 14 and are located on a circle 12 (FIG. 3) which surrounds the nozzle 13 and is also concentric to the axis 2. However, the diameter of the circle 12 is smaller than the diameter of the circle 7 so that the cross-section of the passage which is surrounded and defined by the rods 4 converges in direction from the section 19 towards the section 14.

Because of this, the spacing between circumferentially adjacent ones of the rods 4 is greatest adjacent the downstream end of the nozzle 8 of the section 19. Cooling medium 3 is admitted in large quantities at the upstream end of the passage 19*a* about the workpiece 3 and travels in direction of the straight arrows. Since the nozzle 8 diverges in downstream direction and is immediately followed by the widest spacing between the rods 4, this cooling medium (now designated by the curved arrows $3_1$) can flow very rapidly out between the rods 4, so that contact between it and the workpiece is terminated abruptly. Flow retardation is avoided since the circular cross-section 15 of the rods 4 offers little if any obstruction.

The number of rods 4 may be selected more or less freely, with the proviso that the maximum spacing 9 (FIG. 2) between adjacent rods should be smaller than the cross-section of the workpiece 10, so that the latter cannot become caught in the interstices between the rods.

The section 14 is preferably provided with a mounting member 17 of any suitable type, to permit the arrangement to be mounted in desired positions. It is advantageous if the diameter of the circle 12 equals or substantially equals the largest diameter of the inlet nozzle 13, so that half or about half of the cross-section of each rod 4 is located radially inwardly of this largest diameter (FIG. 3). This facilitates entry of the leading end of the respective workpiece 10 into the nozzle 13 and assures low-friction and trouble-free movement of the workpieces through the section 14.

The resistance to outflow of the cooling fluid $3_1$ (out of contact with the workpiece 10) can be still further reduced if, as shown in FIG. 4, which is otherwise identical with the embodiment of FIGS. 1–3, the rods 4*a* have an oval or elliptical cross-section 16. If the rods 4*a* are so mounted that the major axis of each ellipsis extends radially of the central axis 2*a*, a maximum outflow gap 9*a* for the cooling fluid can be obtained without in any way disadvantageously influencing the guidance of the workpieces 10.

Figure 5:
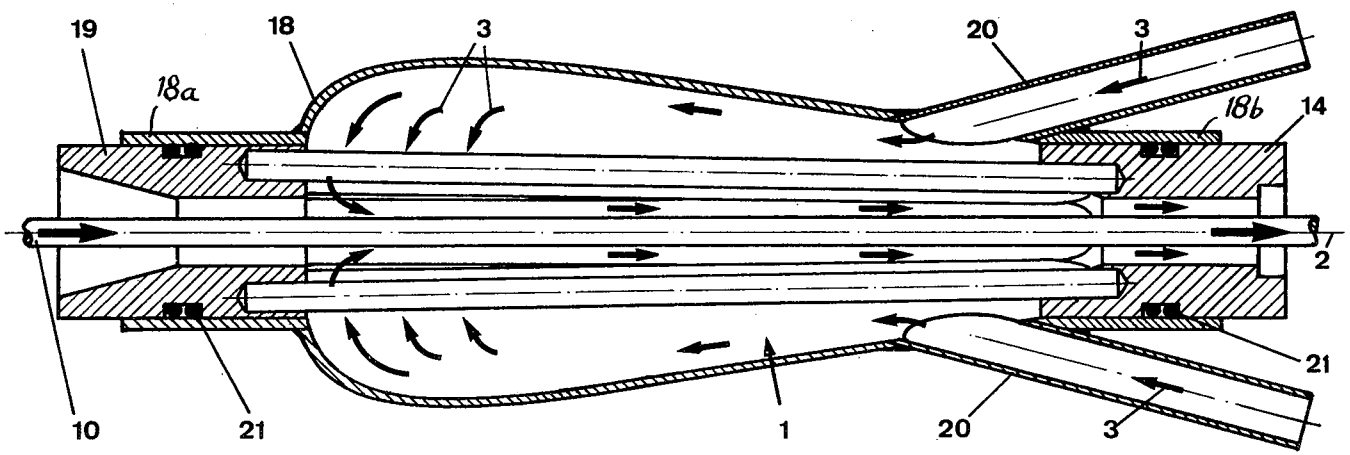
FIG. 5 is a longitudinal section through another embodiment of the invention.

In the embodiment of FIG. 5 like elements are designated with the same reference numerals as in the preceding Figures. Here, however, the arrangement includes a housing or jacket 18 through which the cooling fluid is admitted.

The housing 18 may have spaced tubular end portions 18*a*, 18*b* which are pushed over the sections 19 and 14, respectively. Any suitable seals, for example O-rings 21, may be used to seal these portions 19, 14 against the escape of liquid. The mechanical connection to the sections 19, 14 may be made in any suitable manner, e.g. by bolts, welds, friction fit or the like. The jacket 18 is provided with inlet nipples 20 which preferably extend tangential to the axis 2 and through which cooling fluid 3 is admitted. This arrangement provides for an optimal guidance of the cooling fluid 3 to the workpiece 10, as indicated by the arrows. If the cooling fluid 3 enters the jacket 18 tangentially, the fluid will rotate about the workpiece 10 with resulting increased flow turbulence which further improves the heat exchange with the workpiece.

Figure 6:
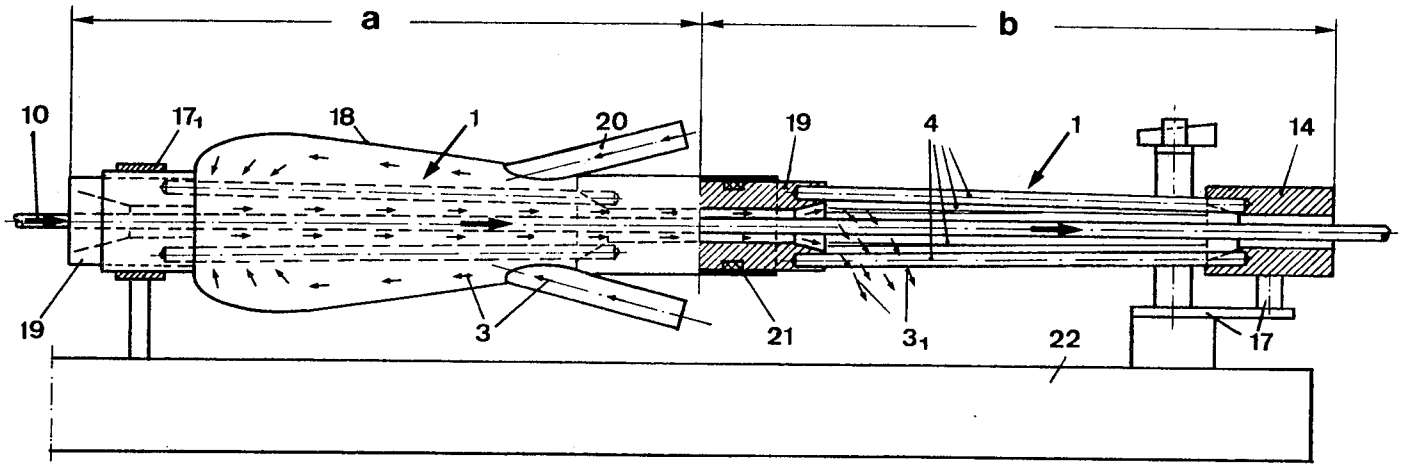
FIG. 6 is a longitudinal section through still a further embodiment.

FIG. 6 shows that the embodiments of FIGS. 1 and 5 may be combined, if it is desired to obtain two separate treating zones a and b, respectively, zone a serving for supplying and admitting cooling fluid into contact with the workpiece travelling through said passages and zone b serving for discharging the cooling fluid by rapid escape between the bars 4. In fact, the embodiment of FIG. 1 can be readily converted into that of FIG. 5, and vice versa, simple by installing of removing the jacket 18.

IN FIG. 6, the same elements as before are designated with like reference numerals. Numeral 22 identifies a base on which the mounting arrangement 17 is secured and/or 22 may be a collector for cooling fluid (e.g., a simple trough). Another mounting arrangement 17 is provided for the section 19 at the left end of the arrangement.

Since in effect only a single type of arrangement is needed, which can be converted at will by adding or removing the jacket 18, manufacturing costs, stock-keeping problems and investment expenses are all significantly reduced. A single type of arrangement permits the construction of highly effective cooling and discharging installations of short overall lenth for intermittent cooling or chilling and reheating of workpieces. The number of cooling and reheating stages can be selected at will and the overall cost is within economically readily acceptable limits. Thus, the invention permits the desired interval-type pressure cooling which assures the production of steel of uniformly high quality.

The herein disclosed arrangements may also be combined with others known from the prior art (i.e., be arranged upstream or downstream of such others) if it is desirable to obtain (for certain portions of the workpieces being treated with a prior-art arrangement) the more intensive intermittent cooling action offered by the inventive arrangement.

Due to the excellent guidance afforded the workpieces 10 by the inventive arrangement, there is no danger that the workpieces might contact the wall of the arrangement and thus become non-uniformly cooled. Cooling fluid of uniform temperature and turbulence can always reach the entire surface of a long section of workpiece in great quantity and can very rapidly be removed from the surface of the workpiece, so that uniform intermittent cooling or chilling and reheating of the workpiece surface is assured.

While the invention has been illustrated and described as embodied in a cooling arrangement for rolled stock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cooling arrangement, particularly for cooling rolled stock including wires, rods and the like, comprising at least one unit which includes a first end member and a second end member which are longitudinally spaced from one another and which have respective axially aligned passages; a plurality of bars connecting said end members and angularly spaced about the axis of alignment of said passages, said bars having first ends connected to said first end member on a first circle surrounding the passage of said first end member and also having second ends connected to said second end member on a smaller-diameter second circle surrounding the passage of said second end member, so that the space bounded by said bars converges from said first towards said second end member; means for admitting a flow of cooling fluid under pressure into contact with a workpiece travelling through said passages; and means for allowing the cooling fluid to escape between said bars subsequent to such contact.

2. A cooling arrangement as defined in claim 1, wherein said passage of said second end member has an upstream portion which converges in downstream direction; and wherein a part of the cross-section of each of said bars overlaps the free cross-section of said upstream portion.

3. A cooling arrangement as defined in claim 2, wherein said second circle has a diameter at most equal to the maximum diameter of said upstream portion.

4. A cooling arrangement as defined in claim 2, wherein said part corresponds to about half the cross-sectional area of the respective bars.

5. A cooling arrangement as defined in claim 1, wherein said bars are of circular cross-section.

6. A cooling arrangement as defined in claim 1, wherein said bars are of elliptical cross-section.

7. A cooling arrangement as defined in claim 1, wherein the major axis of each elliptical cross-section extends radially of said axis of alignment.

8. A cooling arrangement as defined in claim 1; and further comprising means for supplying cooling fluid through said plurality of bars to said workpiece travelling through said passages, comprising a removable tubular jacket surrounding said bars with clearance and having spaced end portions in sealing engagement with said end member.

9. A cooling arrangement as defined in claim 8, wherein said tubular jacket is concentric to said axis of alignment.

* * * * *